US008833490B2

(12) United States Patent
Johnson

(10) Patent No.: US 8,833,490 B2
(45) Date of Patent: Sep. 16, 2014

(54) SELF-CIRCULATING DRILL BIT

(75) Inventor: Ashley Johnson, Milton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 842 days.

(21) Appl. No.: 12/743,599

(22) PCT Filed: Nov. 6, 2008

(86) PCT No.: PCT/EP2008/009610

§ 371 (c)(1),
(2), (4) Date: Sep. 2, 2010

(87) PCT Pub. No.: WO2009/065523

PCT Pub. Date: May 28, 2009

(65) Prior Publication Data

US 2010/0319995 A1 Dec. 23, 2010

(30) Foreign Application Priority Data

Nov. 22, 2007 (GB) ..... 0722907.3

(51) Int. Cl.

| | |
|---|---|
| ***E21B 7/00*** | (2006.01) |
| ***E21B 21/12*** | (2006.01) |
| ***E21B 4/00*** | (2006.01) |
| ***E21B 21/00*** | (2006.01) |
| ***E21B 10/60*** | (2006.01) |

(52) U.S. Cl.

CPC ..... *E21B 21/12* (2013.01); *E21B 4/006* (2013.01); *E21B 21/00* (2013.01); *E21B 10/60* (2013.01)

USPC ..... 175/57

(58) Field of Classification Search

USPC ..... 175/79–83

See application file for complete search history.

(56) References Cited

U.S. PATENT DOCUMENTS 4,312,415 A * 1/1982 Franks, Jr. ..... 175/215
4,368,787 A 1/1983 Messenger (Continued)

FOREIGN PATENT DOCUMENTS

GB 2152588 8/1985
SU 623954 9/1978

(Continued)

OTHER PUBLICATIONS

Search Report for the equivalent GB patent application No. 0722907.3 issued on Mar. 13, 2008.

*Primary Examiner* — Shane Bomar
*Assistant Examiner* — Kipp Wallace
(74) *Attorney, Agent, or Firm* — Stephanie Chi; Jody DeStefanis

(57) ABSTRACT

A drilling system comprising a drive shaft having a fluid flow conduit extending therethrough; a drill bit mounted for rotation by the drive shaft and having a bit face which, in use, contacts a formation to be drilled, and including a fluid flow passage with an outlet near the center of the bit face; a first fluid flow line extending from the outside of the drive shaft to the flow passage in the drill bit; and a second fluid flow line extending from the outside of the drive shaft to the flow conduit. A method of drilling a well using such a system comprise positioning the system in a borehole; rotating the drive shaft to rotate the bit; urging the bit against the formation to be drilled; and pumping drilling fluid down the borehole so as to pass though the first flow line and to exit the fluid flow passage in the drill bit via the outlet, flow over the bit face and pass into the fluid low conduit via the second fluid flow line.

7 Claims, 3 Drawing Sheets

(56) References Cited

U.S. PATENT DOCUMENTS

| | | | | |
|---|---|---|---|---|
| 4,543,019 | A | 9/1985 | Shikata | |
| 4,657,092 | A * | 4/1987 | Franks, Jr. | 175/232 |
| 5,590,725 | A | 1/1997 | Blickhan | |
| 2004/0163852 | A1 | 8/2004 | Broom | |
| 2006/0076162 | A1 | 4/2006 | Tchakarov | |
| 2006/0213691 | A1 * | 9/2006 | Barton et al. | 175/325.5 |
| 2006/0283636 | A1 | 12/2006 | Reagan | |
| 2007/0278007 | A1 * | 12/2007 | Krueger et al. | 175/25 |
| 2008/0000696 | A1 * | 1/2008 | McGarian et al. | 175/256 |
| 2008/0217987 | A1 * | 9/2008 | Southard | 299/60 |
| 2011/0214920 | A1 * | 9/2011 | Vail et al. | 175/57 |

FOREIGN PATENT DOCUMENTS

| | | |
|---|---|---|
| WO | 92/11436 | 7/1992 |
| WO | 0075476 | 12/2000 |

* cited by examiner

SELF-CIRCULATING DRILL BIT

CROSS-REFERENCE TO RELATED APPLICATIONS

The present application is based on and claims priority to GB Application No. 0722907.3, filed 22 Nov. 2007; and International Patent Application No. PCT/EP2008/009610, filed 6 Nov. 2008. The entire contents of each are herein incorporated by reference.

TECHNICAL FIELD

This invention relates to drill bits, and in particular to drill bits used for drilling oil and gas wells and the like.

BACKGROUND ART

In conventional rotary drilling systems such as are used in the oil and gas industry, a drill string is formed by connecting drill pipes together and mounting a drill bit at the lower end of the drill string. The bit is rotated by rotating the drill string and, by applying weight to the bit, is caused to drill ahead through the underground formations. Drilling fluid ('mud') is pumped down the inside of the drill string, out through holes in the bit then back up the annulus transporting drilled cuttings back to the surface. The mud also serves to lubricate the bit and balance the pressure of pore fluids in the formation drilled until it can be lined or cased.

In reverse circulation, mud is pumped down the annulus and into the inside of the drill string through the drill bit to return to the surface. In certain cases, crossover subs have been proposed to divert flow from the drill string into the annulus near the bit and/or return flow from the annulus into the inside of the drill string.

In cases where there is limited annular space (as may be the case in coiled tubing drilling, for example), reverse circulation may be preferred since the inside of the drill string may provide a better path for mud and cuttings than the narrow annulus that might become easily blocked by the cuttings.

It has recently been proposed to drill using a bottom hole assembly ('BHA') with an electrically powered drilling tool for driving the bit powered via a wireline cable rather than a conventional drill string. In this case, the preferred circulation is down the annulus across the toolface and radially into the center of the bit then back up through the inside of the BHA in view of the limited annulus in the region of the bit.

However, in this scenario the centripetal forces on the fluid caused by the rotation of the bit are acting against the direction of flow of the fluid, increasing the bit pressure drop as the rotary speed increases. In drilling tests at rotary speeds above 200 rpm the cuttings were forced out to the outer edge of the bit, by the centripetal forces, and were not convected out from the bit with the drilling fluid. In one set of tests, the pressure drop increased from about 1.7 psi to about 3.2 psi as the rotary speed was increased from 50 to 750 rpm.

It is an object of the invention to provide a system that avoids both the problem of a limited annulus and of the rotating bit when transporting drilled cuttings.

DISCLOSURE OF INVENTION

A first aspect of the invention provides drilling system comprising: a drive shaft having a fluid flow conduit extending therethrough; a drill bit mounted for rotation by the drive shaft and having a bit face which, in use, contacts a formation to be drilled, and including a fluid flow passage with an outlet near the center of the bit face; a first fluid flow line extending from the outside of the drive shaft to the flow passage in the drill bit; and a second fluid flow line extending from the outside of the drive shaft to the flow conduit.

Preferably, the drive shaft is mounted for rotation in a bottom hole assembly (BHA). In this case, the first and second fluid flow lines can extend through the BHA to the bit and drive shaft respectively. The fluid flow lines can therefore comprise first parts formed in the BHA and second parts formed in the bit or drive shaft respectively. The second part of the second passage can comprise one or more holes extending from the conduit. The holes can be angled to the radial direction.

In one preferred embodiment, a baffle is provided which extends around the periphery of the BHA near the bit, the first fluid line having an inlet which is on the opposite side of the baffle to the drill bit, and the second fluid line having an inlet between the baffle and the drill bit.

A second aspect of the invention provides a method of drilling a well using a system according to the first aspect of the invention, the method comprising: positioning the system in a borehole; rotating the drive shaft to rotate the bit; urging the bit against the formation to be drilled; and pumping drilling fluid down the borehole so as to pass through the first flow line and to exit the fluid flow passage in the drill bit via the outlet, flow over the bit face and pass into the fluid flow conduit via the second fluid flow line.

BRIEF DESCRIPTION OF FIGURES IN THE DRAWINGS

MODE(S) FOR CARRYING OUT THE INVENTION

Figure 1:
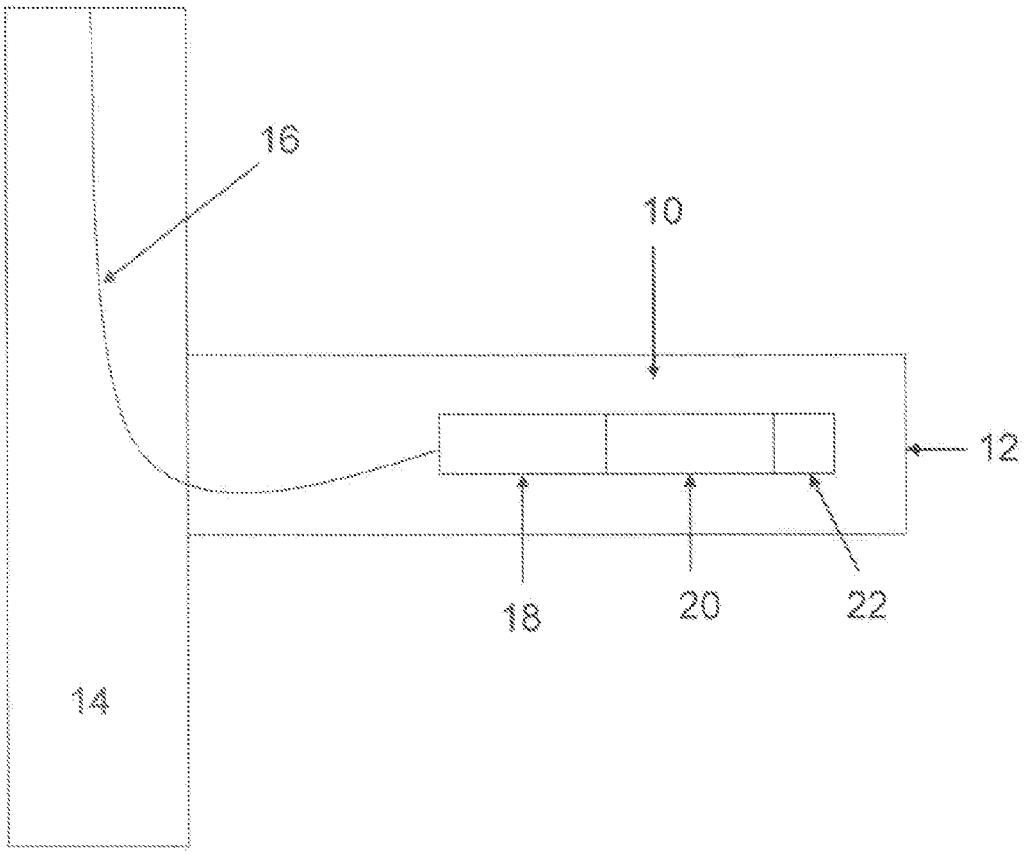
FIG. 1 shows a schematic diagram of a wireline drilling system.

This invention finds a particularly preferred application in wireline drilling systems which have been proposed for drilling lateral boreholes from a main well. FIG. 1 shows a schematic diagram of such a system, comprising a downhole drilling system 10 which is positioned in a lateral well 12 extending from a main well 14. The downhole drilling system 10 is connected to the surface by means of a wireline cable 16 which provides power and control signals during operation. The drilling system 10 comprises a BHA including a tractor system 18 for moving the BHA along the lateral well 12, a power and drive module 20 for converting the electrical power provided by the cable 16 into mechanical drive for rotating a drill bit 22 and applying weight on bit during drilling. Such systems are proposed for drilling relatively narrow lateral boreholes. The size of the motors used and the limitations of the wireline cable mean that these systems are considered to be 'low power' drilling systems when compared to conventional drilling technology.

For a low power drilling system, it is desirable to have a high rotation speed bit. When combined with reverse circulation, the centripetal forces imparted by the bit on the drilling fluid act in the opposite direction to the desired fluid flow and can force the cuttings out to the outer edge of the tool face and prevent them from flowing to the flow exit in the center of the bit.

This invention is based on a hydraulic arrangement where the flow around the bit is 'conventional' and driven by the pumping action of the bit itself, but the reverse circulation of the main hydraulic circuit sweeps the cuttings up and returns then through the inside of the drilling tool.

Figure 2:
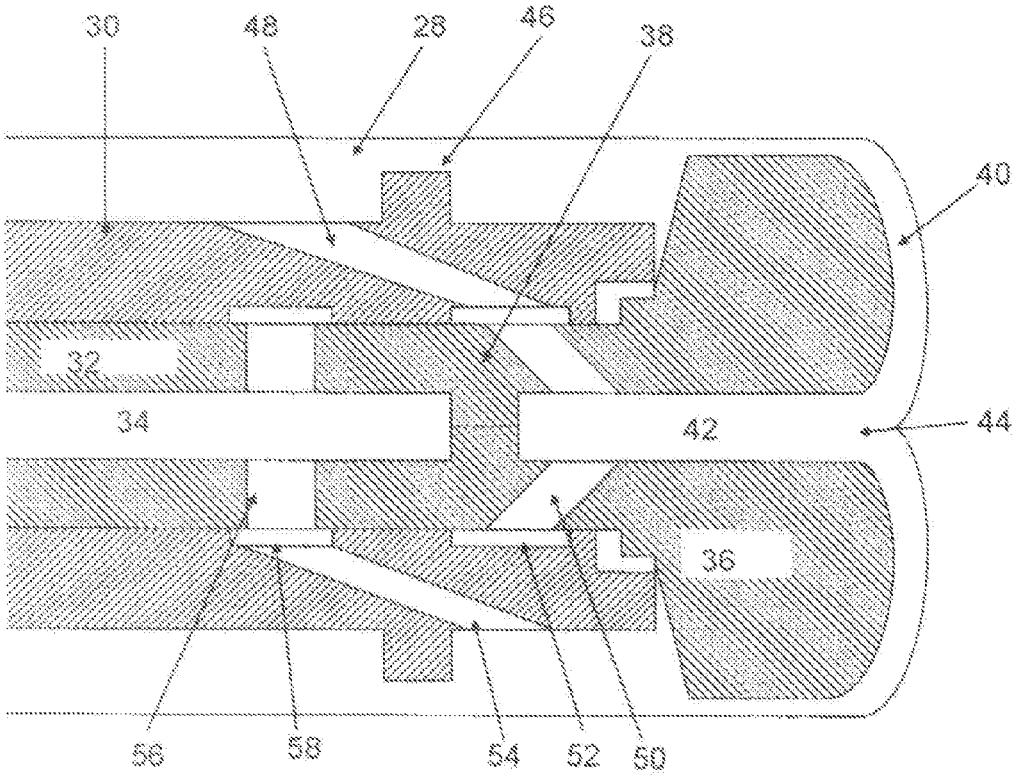
FIG. 2 shows one embodiment of a system according to the invention.
Figure 3:
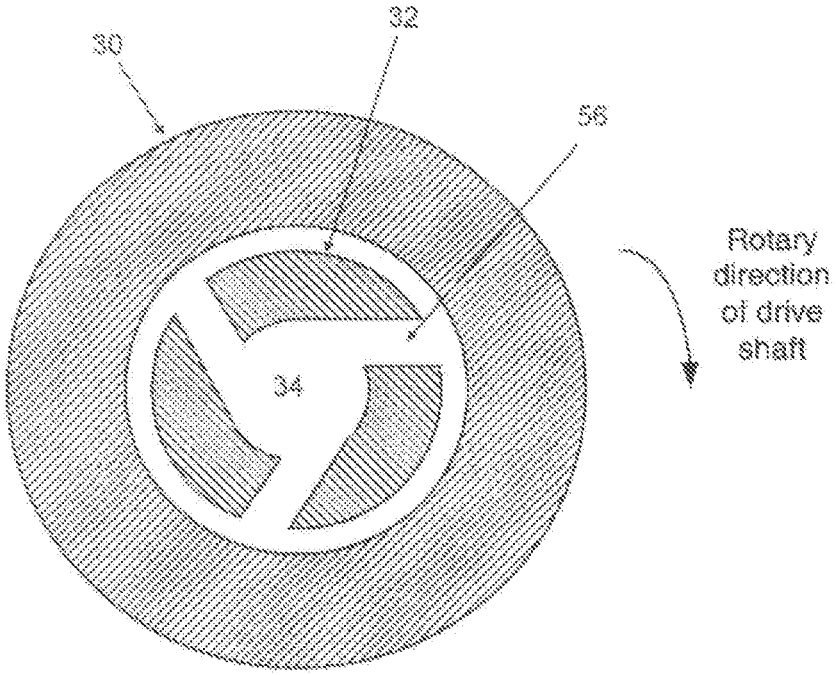
FIG. 3 shows a modification of part of the embodiment of FIG. 2.

FIG. 2 shows a diagram of the end of a BHA incorporating the present invention located in a borehole 28 and comprising a BHA housing 30 in which is mounted a hollow drive shaft 32 having a flow conduit 34 extending along the center thereof. A drill bit 36 is connected to one end 38 of the drive shaft 32 (the other end, not shown, is connected to a motor forming part of the power and drive module 20).

The drill bit 36 has a bit face 40 that is the part which performs most of the drilling work in use. A flow passage 42 extends along the center line (axis of rotation) of the bit 36 with an outlet 44 in the center of the bit face 40.

The connection between the drive shaft 32 and the bit 36 is such that there is no direct connection between the flow conduit 34 and the flow passage 42.

A baffle 46 projects from the outer wall of the BHA housing 30 so as to extend around its periphery in the region of the bit 36. The outer diameter of the baffle 46 is less than that of the bit 36. The BHA housing 30 is provided with flow lines to act as a crossover sub for flow between the annulus around the tool in the borehole and the interior of the tool (in this case the terms 'above' and 'below' are use to indicate positions towards the surface of the borehole and towards the bottom of the borehole respectively when the tool is in use in its normal configuration). A first flow line 48 extends from the outer surface of the housing 30 above the baffle 46 to connect to connecting ports 50 in the bit 36 which extend to the flow passage 42. Several connecting ports 50 are provided around the passage 42 and an annular chamber 52 is defined in the inner surface of the housing 30 to act as a manifold such that fluid communication can be maintained with the ports 50 as the bit 36 rotates. A second flow line 54 extends from the outer surface of the housing 30 below the baffle 46 to connect to connecting ports 56 in the drive shaft 32 which extend to the flow conduit 34. Several connecting ports 56 are provided around the conduit 34 and an annular chamber 58 is defined in the inner surface of the housing 30 to act as a manifold such that fluid communication can be maintained with the ports 56 as the shaft 32 rotates.

The structure of the flow lines 48, 54 described above provides a cross over assembly which directs the fluid coming down the annulus into the center passage 42 of the bit 36. From there it is sucked out over the bit face 40 and pumped by the centripetal force created by rotation of the bit radially out to the annulus around the bit 36. It then returns through the cross over to the conduit 34 down the center of the drive shaft 32 where it passes back up the tool and out of the borehole. Alternatively cuttings may be removed from the fluid downhole with cuttings free fluid being discharged into the annulus to flow back down the annulus to be drawn back into the drill bit. The BHA can include a pump to draw the fluid that is coming down the annulus through the ports 50 into the center passage 42.

FIG. 2 shows an embodiment with a baffle 46. Simpler solutions are possible but are considered less efficient. The baffle will provide a slight hydraulic benefit (the pressure of the downflow in the annulus on the baffle will provide an additional 'weight-on-bit' effect') and it will assist the hole cleanup by allowing accelerated fluid flowing past the baffle to sweep cuttings along the wellbore towards the bit (and hence to be carried by the flow into the line 54 and thus into the conduit 34), minimizing the cuttings left in the hole.

In this scenario the rotary motion of the bit generates the pumping action to circulate the drilling fluid. Integration allows the (ideal) pressure rise due to these forces to be calculated as: $\Delta P=\frac{1}{2}\rho\omega^2r^2$, where $\rho$ is the fluid density, $\omega$ the rotary speed and r the radius of the bit. The same equation is derived for centrifugal pump performance.

For the 3⅜" bit with water at 600 RPM a pressure rise of about 0.54 psi is calculated. The smallest passage will be the one through the core of the bit. In one example of an existing bit this has a diameter of 26 mm. Assuming a liquid flow rate of 10 gpm we can calculate the pressure drop (of one dynamic head, $\frac{1}{2}\rho v^2$) of 0.1 psi. The pumping effect of the bit can therefore generate sufficient head to clean the bit.

With this process the pressure rise due to centripetal forces from the bit will be countered by the centripetal forces where the fluid flows into the center of the drive shaft. These effects can be countered by angling the ports 56 away from the radial direction as shown in FIG. 5.

Other changes can be made while staying within the scope of the invention.

The invention claimed is:

1. A drilling system comprising:

a drive shaft having a fluid flow conduit extending therethrough;

a drill bit mounted for rotation by the drive shaft and having a bit face which, in use, contacts a formation to be drilled, and having a fluid flow passage with an outlet near the center of the bit face;

a baffle projecting from an outer periphery of the drive shaft, wherein an outer diameter of the baffle is less than an outer diameter of the drill bit;

a first fluid flow line extending from the outside of the drive shaft to the flow passage in the drill bit, wherein the first fluid flow line is configured to direct fluid flowing down an annulus into the fluid flow passage of the drill bit; and a second fluid flow line extending from the outside of the drive shaft to the fluid flow conduit, wherein the second fluid flow line is configured to return fluid around the drill bit to the fluid flow conduit of the drive shaft, wherein the first fluid line has an inlet which is on an opposite side of the baffle to the drill bit, and the second fluid line has an inlet between the baffle and the drill bit.

2. The system as claimed in claim 1, wherein, the drive shaft is mounted for rotation in a bottom-hole assembly ("BHA").

3. The system as claimed in claim 2, wherein the first and second fluid flow lines extend through the BHA to the bit and drive shaft respectively.

4. The system as claimed in claim 3, wherein the first and second fluid flow lines comprise first parts formed in the BHA and second parts formed in the bit or drive shaft respectively.

5. The system as claimed in claim 4, wherein the second part of the second flow line comprises one or more holes extending from the fluid flow conduit.

6. The system as claimed in claim 5, wherein the holes are be angled to the radial direction.

7. A method of drilling a well, comprising the steps of:

positioning a drilling system in a borehole, the drilling system comprising:

a drive shaft having a fluid flow conduit extending therethrough;

a drill bit mounted for rotation by the drive shaft and having a bit face which, in use, contacts a formation to be drilled, and having a fluid flow passage with an outlet near the center of the bit face;

a baffle projecting from an outer periphery of the drive shaft, wherein an outer diameter of the baffle is less than an outer diameter of the drill bit;

a first fluid flow line extending from the outside of the drive shaft to the fluid flow passage in the drill bit; and a second fluid flow line extending from the outside of the drive shaft to the fluid flow conduit, wherein the first fluid flow line has an inlet which is on an opposite side of the baffle to the drill bit, and the second fluid flow line has an inlet between the baffle and the drill bit;

rotating the drive shaft to rotate the bit;

urging the bit against the formation to be drilled; and pumping drilling fluid down the borehole so as to pass through the first flow line and to exit the fluid flow passage in the drill bit via the outlet, and flow over the bit face and pass into the fluid flow conduit via the second fluid flow line.

* * * * *